US005580467A

United States Patent [19]

Kim

[11] Patent Number: 5,580,467

[45] Date of Patent: Dec. 3, 1996

[54] METHOD OF FABRICATING A FIELD EMISSION MICRO-TIP

[75] Inventor: Jong-min Kim, Seoul, Rep. of Korea

[73] Assignee: Samsung Display Devices Co., Ltd., Suwon, Rep. of Korea

[21] Appl. No.: 509,058

[22] Filed: Jul. 31, 1995

[30] Foreign Application Priority Data

Mar. 29, 1995 [KR] Rep. of Korea ..... 95-6888

[51] Int. Cl.[6] ..... H01J 1/30

[52] U.S. Cl. ..... 216/11; 313/309; 313/310; 445/50; 216/100; 216/102

[58] Field of Search ..... 216/11, 13, 100, 216/102–104; 445/50, 51; 313/309, 310, 351

[56] References Cited

U.S. PATENT DOCUMENTS

| | | | |
|---|---|---|---|
| 4,827,177 | 5/1989 | Lee et al. | 313/309 |
| 5,144,191 | 9/1992 | Jones et al. | 313/308 |
| 5,148,079 | 9/1992 | Kado et al. | 313/309 |
| 5,176,792 | 1/1993 | Fullowan et al. | 156/652 |
| 5,214,347 | 5/1993 | Gray | 313/355 |
| 5,219,310 | 6/1993 | Tomo et al. | 445/24 |
| 5,378,963 | 1/1995 | Ikeda | 313/495 |
| 5,386,172 | 1/1995 | Komatsu | 313/309 |

*Primary Examiner*—R. Bruce Breneman
*Assistant Examiner*—Anita Alanko
*Attorney, Agent, or Firm*—Foley & Lardner

[57] ABSTRACT

A method of fabricating a field emission micro-tip which can emit electrons uniformly and can be fabricated at a high yield when applied to a large device. The micro-tip is fabricated such that when the adhesive layer and mask are instantaneously etched the tungsten micro-tips are lifted upwardly due to the differences in internal stress and etching rates of the tungsten cathode, the lower adhesive layer and the upper mask layer. The sharpness of the micro-tip is easily adjusted depending on the shape of the micro-tip. Also, since the internal stress of tungsten and characteristics of the BOE method are utilized throughout the fabricating process, the reproducibility is ensured. Moreover, since multiple tips are fabricated, the output current can be manipulated in a wide range of nanoamperes to milliamperes. Since tungsten is used for fabricating the micro-tips, excellent properties are obtained with regard to strength, oxidation, work function, and electrical, chemical and mechanical durability.

15 Claims, 3 Drawing Sheets

METHOD OF FABRICATING A FIELD EMISSION MICRO-TIP

BACKGROUND OF THE INVENTION

The present invention relates to a method of fabricating a field emission micro-tip which can emit electrons uniformly and can be fabricated at a high yield when applied to a large device.

As an image display device to replace the cathode ray tube of existing television receivers, flat panel displays have been under vigorous development for use as in wall-mounted (tapestry) televisions and high definition televisions (HDTV).

Such flat panel displays include plasma display panels, liquid crystal displays, and field emission displays. Among these, the field emission display is widely used owing to the quality of its screen brightness and low power consumption.

Referring to FIG. 1, the structure of a conventional vertical field emission micro-tip will now be described.

The vertical field emission micro-tip includes an glass substrate 1, a cathode 2 formed on the glass substrate 1 a micro-tip 4 for field emission formed on cathode 2, an insulating layer 3 formed above glass substrate 1 having a hole 3' surrounding micro-tip 4 on cathode 2, and a gate layer 5 formed on insulating layer 3 having an aperture 5' to allow field emission from micro-tip 4.

FIG. 2A is a vertical cross-section of a conventional horizontal field emission micro-tip and FIG. 2B is a plan view of the horizontal field emission micro-tip shown in FIG. 2A. As shown, in contrast with the vertical field emission micro-tip shown in FIG. 1, the structure of the horizontal field emission micro-tip has a cathode 10 and an anode 8 that are horizontally formed above a substrate 6 so that electrons are emitted horizontally with respect to the substrate 6.

The structure of the horizontal field emission micro-tip will now be described in detail.

An insulating layer 7 is formed on a glass substrate 6. A cathode 10 and an anode 8 are deposited on insulating layer 7 with a predetermined spacing. A hole 7' is formed on the insulating layer 7 between cathode 10 and anode 8 to a predetermined depth. A gate electrode 9 is provided within hole 7' to control electron emission from cathode 10 to anode 8.

In the case of the vertical field emission micro-tip using a single tip as shown in FIG. 1, since the flow of electron beams depends on the size of gate aperture 5' a fabrication technique applicable to a micro-tip with several tens of nanometers in diameter is desired. In other words, in order to fabricate a high-precision gate aperture for the vertical field emission micro-tip of several tens of nanometers, a highly advanced microfabrication technique of submicron units is necessary. Thus, there are problems such as non-uniformity throughout the fabrication process and a lowered yield when fabricating larger devices. Also, if the gate aperture is larger, a higher level of bias voltage must be applied to the gate, thereby necessitating a higher voltage for driving the device.

The horizontal field emission micro-tip shown in FIG. 2A has a higher yield and a more uniform structure, compared with the vertical field emission micro-tip. However, variable application of the horizontal field emission micro-tip is difficult, since the flow of electrons is restricted to a horizontal direction. As a result, electron beam application using the horizontal field emission micro-tip is very difficult.

SUMMARY OF THE INVENTION

In order to solve the aforementioned problems, it is an object of the present invention to provide a method of fabricating a field emission micro-tip which can emit electrons uniformly and can be fabricated at a high yield when applied to a large device.

To accomplish the above object, the method of fabricating a field emission micro-tip according to the present invention comprises the steps of: sequentially depositing on a substrate an adhesive layer formed of a material etchable in an etching solution at a first etching rate higher than a predetermined rate, a cathode formed of a metal having an internal stress greater than a value predetermined in relation to an internal stress of the adhesive layer and having a negligible etching rate in the etching solution and a mask layer formed of a material etchable in said etching solution at a second etching rate lower than the first etching rate; forming a metal pattern for supporting the cathode on the mask layer using a lift-off method; forming a triangular mask by patterning the mask layer; forming potential micro-tips by etching the exposed cathode using the mask; and making the potential micro-tips protrude upwardly using the internal stress of the tungsten cathode by etching off portions of the adhesive layer and the mask from the upper and lower portions of the potential micro-tips respectively within a predetermined time.

In the present invention, the adhesive layer and mask layer depositing steps are preferably performed by depositing either titanium or aluminum to a thickness of 2,000 Å and 1,000 Å, respectively, using a DC-magnetron sputtering method or electron-beam deposition method.

The cathode depositing step is preferably performed by depositing tungsten to a thickness of 1 μm using a DC-magnetron sputtering method or electron-beam deposition method.

The mask forming step preferably includes the sub-steps of forming a predetermined photoresist mask on the mask layer and etching the mask layer by a reactive ion etching (RIE) method using the photoresist mask.

The metal pattern forming step is preferably performed using a lift-off method.

The mask forming step is preferably performed using a lift-off method.

The potential micro-tip forming step is preferably performed by etching the mask using $CF_4$—$O_2$ plasma.

The micro-tip forming step is preferably performed by a buffered oxide etching method using an etching solution containing HF and $NH_4F$ in the ratio of 7 to 1 up to 10 to 1.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
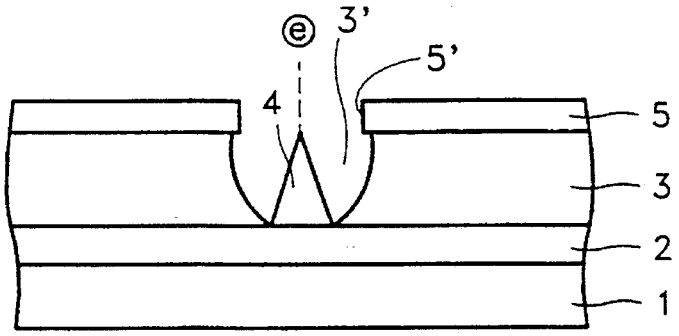
FIG.1 (PRIOR ART)
FIG. 1 is a vertical cross-section of a conventional vertical field emission micro-tip.
Figure 2A:
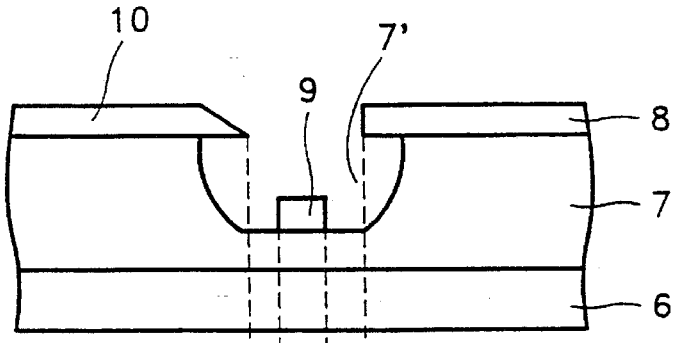
FIG.2A (PRIOR ART)
FIGS. 2A and 2B are a vertical cross-section and a plan view of a conventional horizontal field emission micro-tip, respectively.
Figure 2B:
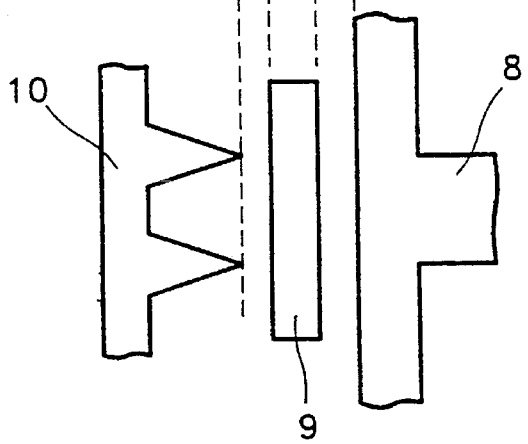
FIG.2B (PRIOR ART)
Figure 3:
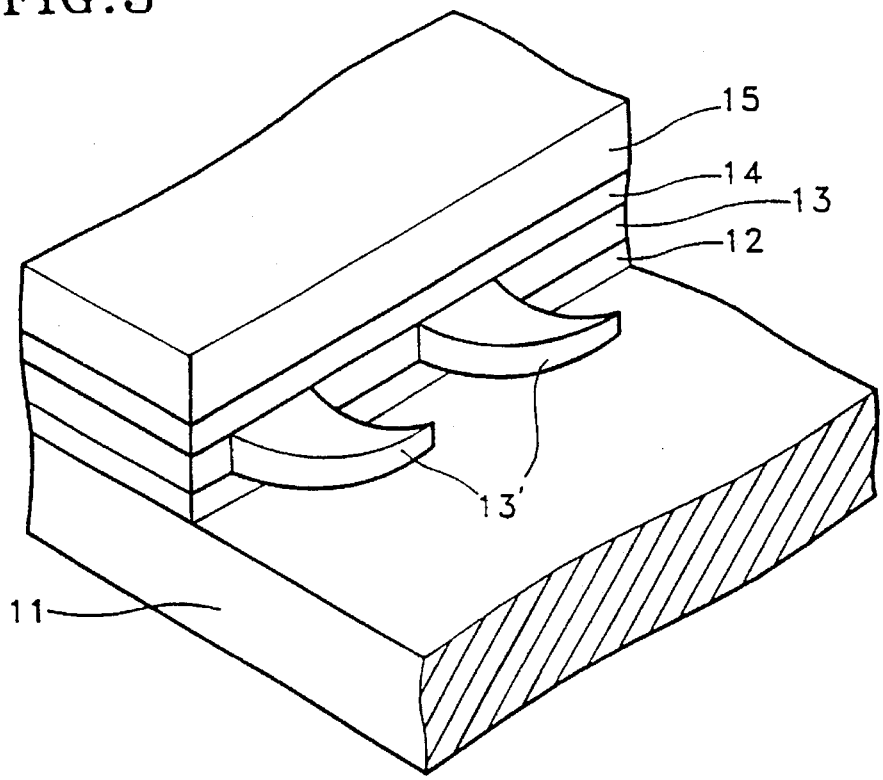
FIG. 3 is a perspective view of a field emission micro-tip according to the present invention.

Referring to FIG. 3, the structure of the field emission micro-tip according to the present invention will be first described.

The field emission micro-tip according to the present invention is structured such that an adhesive layer 12, a cathode 13 and a micro-tip 13', a mask layer 14, and a cathode supporting layer 15 are sequentially deposited on a glass substrate 11. Here, adhesive layer 12 is formed by depositing either titanium or aluminum to a thickness of 2,000 Å. Cathode 13 is formed by depositing tungsten to a thickness of 1 μm. Micro-tip 13' is formed by patterning cathode 13 partially in a triangular shape protruding upwardly by an angle of 60°~70°. Mask layer 14 is formed by depositing either titanium (Ti) or aluminum (Al) to a thickness of 1,000 Å, and then patterning in a similar shape to adhesive layer 12. Cathode supporting layer 15 is formed by depositing chrome (Cr) and patterning in stripe. Here, adhesive layer 12 and mask layer 14 are formed by selecting a pair from the group consisting of pairs of Ti and Al, Al and Ti, Al and Al, and Ti and Ti. Among these pairs, the pair of Ti and Al is the most preferable for the adhesive and mask layers. Tungsten (W) which is the cathode material between the selected pair has strong internal stress compared with the selected pair.

The selected pair Ti and Al, are etched very rapidly, while tungsten is not etched. Thus, micro-tip 13' is formed by the severe differences in the etching rate and internal stress of the cathode, the adhesive layer and the mask layer. In other words the microtip 13' patterned in a triangular shape is formed to protrude upwardly as a result of the strong internal stress of tungsten when adhesive layer 12 and mask 14 are instantaneously etched off.

The method for fabricating the field emission micro-tip having the aforementioned structure will now be described.

First, titanium (Ti) is deposited on a glass substrate 11 to a thickness of 2,000 Å to form an adhesive layer 12. Thereafter, tungsten is deposited to a thickness of 1 μm by a DC-magnetron sputtering method to form a cathode layer 13. The cathode layer 13 has a very strong internal stress which is not evident until it is used in protruding the tip pattern of the cathode layer 13 upwardly to a very strong extent during rapid etching of the adhesive layer 12.

Aluminum (Al) is then deposited to a thickness of 1,000 Å by a DC-magnetron sputtering method or an electron-beam deposition method to form a mask layer 14. A chrome pattern is then formed as a cathode supporting layer 15. The chrome pattern is formed using a lift-off method, or by forming and patterning a chrome layer using a lithographic etching method. The chrome pattern serves to support the cathode and prevent separation from the substrate when the micro-tip 13' is protruded upwardly by the internal stress of the tungsten.

Figure 4A:
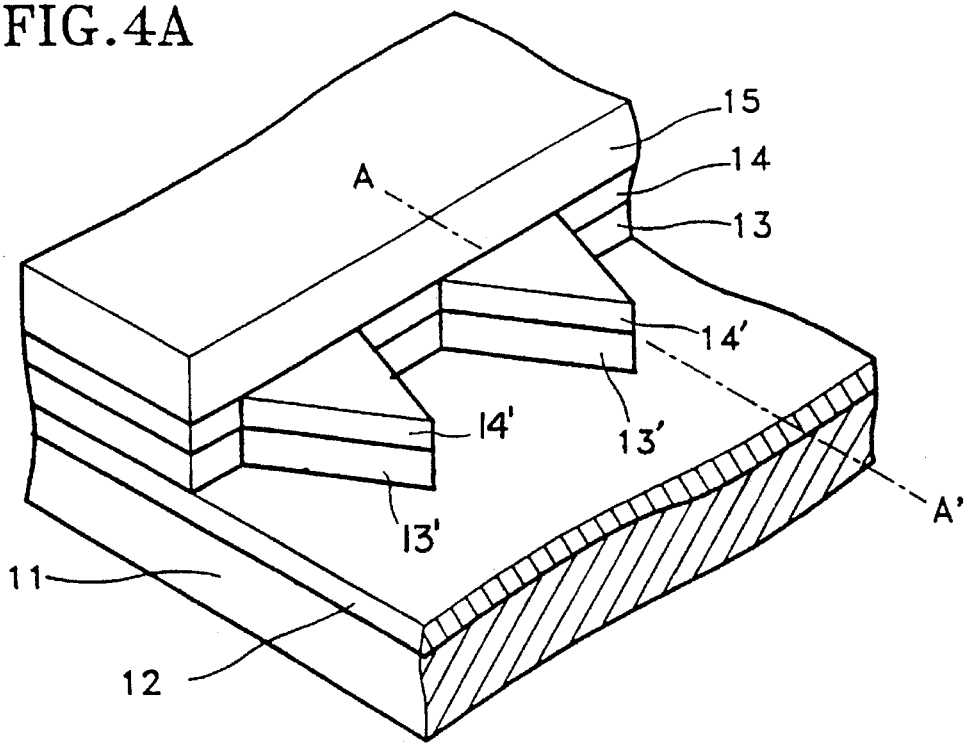
FIGS. 4A and 4B are a partly exploded perspective view and a vertical cross-section, respectively, showing the fabrication process of the field emission micro-tip shown in FIG. 3.
Figure 4B:
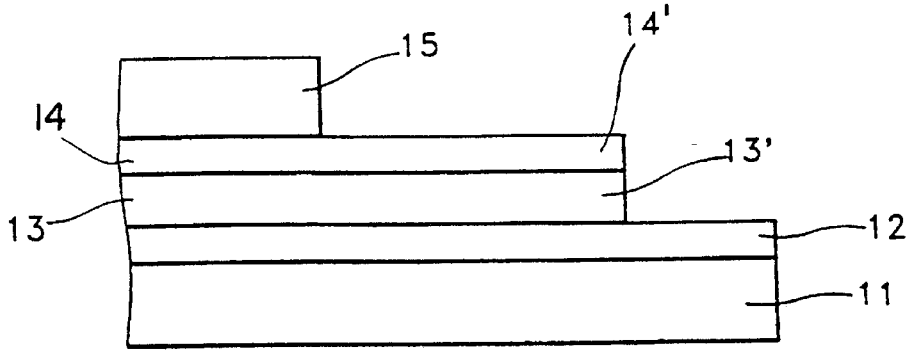

Next, Al mask layer 14 is etched by a reactive ion etching (RIE) method to form a mask 14' for fabricating the micro-tip. Here, a lift-off method may be adopted. At this time, the plane mask 14' is etched to be a sharp triangle, as shown in FIG. 4A. The sharpness of the micro-tip is determined by the patterning method of the mask. As a result, the basic structure of the field emission micro-tip shown in FIGS. 4A and 4B is completed.

Tungsten cathode layer 13 is etched by $CF_4$—$O_2$ plasma using an Al mask 14' to form a micro-tip portion 13. Titanium adhesive layer 12 and Al mask 14' are then instantaneously etched by a buffered oxide etching (BOE) method to complete a microtip 13'. During BOE, when the adhesive layer 12 is instantaneously etched, the separated micro-tip portion 13' projects upwardly from the adhesive layer 12 to the internal stress of the tungsten, thereby completing the micro-tip 13'. Since the etching rate of titanium adhesive layer 12 is very high, it is important to control the etching process which needs to be completed in a short time. The etching solution used during BOE is a mixed solution of HF and $NH_4F$ in a ratio ranging from 7:1 to 10:1.

Figure 5:
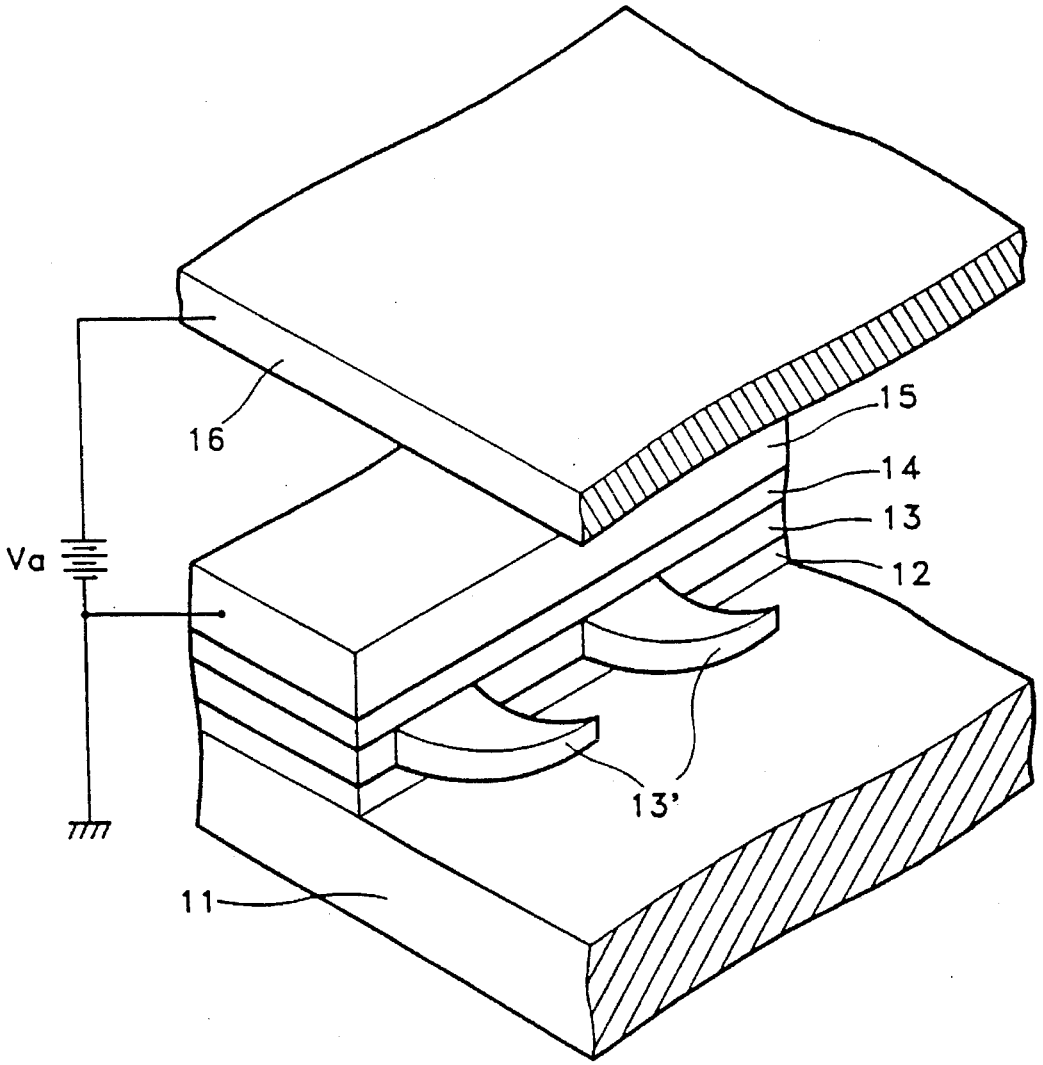
FIG. 5 is a perspective view illustrating a method for driving the field emission micro-tip according to the present invention.

In the field emission micro-tip having the aforementioned structure, an anode 16 is provided the there above as shown in FIG. 5. The edges of the structure are sealed and the space beneath the anode 16 is made into a vacuum having a pressure below $10_{-6}$ torr. If the cathode supporting layer 15 is grounded and a predetermined power voltage is applied to the anode 16, a strong electrical field is formed, such that electrons are emitted from the micro-tip 13'. The field emission micro-tip 13' can be used as a flat panel display, a high-power microwave device, an electron-beam-applied scanning electron microscope, a device for a electron-beam-applied system or a multiple beam emission pressure sensor.

As described above, the field emission micro-tip according to the present invention is fabricated such that when the adhesive layer and mask are instantaneously etched, the tungsten micro-tip portion lifted upwardly due to the differences in internal stress of the tungsten cathode, the lower adhesive layer and the upper mask layer. By adjusting the shape of the mask, the sharpness of the micro-tip is easily adjusted. Also, since the internal stress of tungsten and characteristics of the BOE method are utilized throughout the fabricating process, reproducibility is ensured. Moreover, since multiple tips are fabricated, the output current can be manipulated in a wide range from nanoamperes to milliamperes. Further tungsten is used for fabricating the micro-tips, excellent properties with regard to strength, oxidation, work function, and electrical, chemical and mechanical durability are obtained.

What is claimed is:

1. A method for fabricating a field emission micro-tip, comprising the steps of:

sequentially depositing on a substrate an adhesive layer formed of a material etchable in an etching solution at a first etching rate higher than a certain rate, a cathode layer formed of a metal having an internal stress greater than a value predetermined in relation to an internal stress of the adhesive layer and having a negligible etching rate in the etching solution, and a mask layer formed of a material etchable in said etching solution at a second etching rate lower than said first etching rate;

forming a metal pattern on said mask layer for supporting said cathode layer;

forming a triangular mask by patterning said mask layer;

forming micro-tip portions by etching the exposed cathode layer using said mask layer; and protruding said micro-tip portions upwardly using said internal stress of said cathode layer by etching off portions of said adhesive layer and said mask layer which are above and below said micro-tip portions, respectively, within a certain time.

2. A method for fabricating a field emission micro-tip as claimed in claim 1, wherein said adhesive layer depositing step is performed by depositing titanium.

3. A method for fabricating a field emission micro-tip as claimed in claim 1, wherein said adhesive layer depositing step is performed by depositing aluminum.

4. A method for fabricating a field emission micro-tip as claimed in claim 1, wherein said cathode depositing step is performed by depositing tungsten by a DC-magnetron sputtering method.

5. A method for fabricating a field emission micro-tip as claimed in claim 1, wherein said cathode depositing step is performed by depositing tungsten by an electron-beam deposition method.

6. A method for fabricating a field emission micro-tip as claimed in claim 1, wherein said mask layer depositing step is performed by depositing titanium by a DC-magnetron sputtering method.

7. A method for fabricating a field emission micro-tip as claimed in claim 1, wherein said mask layer depositing step is performed by depositing titanium by an electron-beam deposition method.

8. A method for fabricating a field emission micro-tip as claimed in claim 1, wherein said mask layer depositing step is performed by depositing aluminum by a DC-magnetron sputtering method.

9. A method for fabricating a field emission micro-tip as claimed in claim 1, wherein said mask layer depositing step is performed by depositing aluminum by an electron-beam deposition method.

10. A method for fabricating a field emission micro-tip as claimed in claim 1, wherein said mask forming step includes the sub-steps of forming a photoresist mask on said mask layer and etching said mask layer by a reactive ion etching (RIE) method using said photoresist mask.

11. A method for fabricating a field emission micro-tip as claimed in claim 1, wherein said cathode supporting metal pattern forming step is performed using a lift-off method.

12. A method for fabricating a field emission micro-tip as claimed in claim 1, wherein said mask forming step is preferably performed using a lift-off method.

13. A method for fabricating a field emission micro-tip as claimed in claim 1, wherein said micro-tip portion forming step is performed by etching said mask with $CF_4$—$O_2$ plasma.

14. A method for fabricating a field emission micro-tip as claimed in claim 1, wherein said micro-tip protruding step is performed using a buffered oxide etching method.

15. A method for fabricating a field emission micro-tip as claimed in claim 14, wherein said buffered oxide etching method uses an etching solution containing HF and $NH_4F$ in the ratio of 7:1 to 10:1.

* * * * *